United States Patent [19]

Deike

[11] Patent Number: 4,648,609

[45] Date of Patent: Mar. 10, 1987

[54] DRIVER TOOL

[75] Inventor: Robert F. Deike, Cheyenne, Wyo.

[73] Assignee: Construction Robotics, Inc., Chicago, Ill.

[21] Appl. No.: 693,374

[22] Filed: Jan. 22, 1985

[51] Int. Cl.[4] ..... B25D 17/08

[52] U.S. Cl. ..... 279/19.1; 267/155; 173/131

[58] Field of Search ..... 173/139, 162, 129, 131, 173/132, 133, 119; 279/19, 19.1, 19.2; 267/154, 155, 157

[56] References Cited

U.S. PATENT DOCUMENTS

| | | | |
|---|---|---|---|
| 874,499 | 12/1907 | Gunn | 173/132 |
| 1,389,539 | 8/1921 | Turner | 173/139 |
| 1,399,387 | 12/1921 | Jackson . | |
| 1,954,411 | 7/1930 | Heitzman et al. | 125/34 |
| 2,385,439 | 9/1945 | Gubbins | 173/133 |
| 2,413,542 | 2/1942 | Butts | 121/17 |
| 2,500,402 | 7/1945 | Craig | 255/43 |
| 2,560,559 | 7/1951 | Dearborn | 173/139 |
| 3,054,464 | 6/1958 | Ondeck | 175/145 |
| 3,244,241 | 3/1963 | Ferwerda | 173/105 |
| 3,487,752 | 1/1970 | James | 173/139 |
| 4,072,199 | 7/1978 | Wanner | 173/131 |
| 4,102,410 | 7/1978 | Ross | 173/133 |
| 4,168,751 | 9/1979 | Deike | 173/1 |

*Primary Examiner*—Donald R. Schran
*Assistant Examiner*—James L. Wolfe
*Attorney, Agent, or Firm*—Hill, Van Santen, Steadman & Simpson

[57] ABSTRACT

A torsion or hairpin spring external attachment for power hammers has eye ends respectively bottomed on the power hammer casing and on the tool driven by the hammer for maintaining the tool against the work and supporting a load on the power hammer while reclaiming an optimum spacing of the hammer relative to its anvil after each hammer blow to increase the efficiency of the power hammer. The attachment spring is easily applied and removed and can be supplied in a wide range of stiffness to accommodate different work conditions with the stiffness of the spring increasing with the hardness or impact resistance of the work. Downcrowding loads on the power hammer can be increased while maintaining the optimum spacing of the hammer and anvil to increase the work output of the power hammer. The spring attachment permits rotation of the power driven tool.

7 Claims, 7 Drawing Figures

FIG. 1
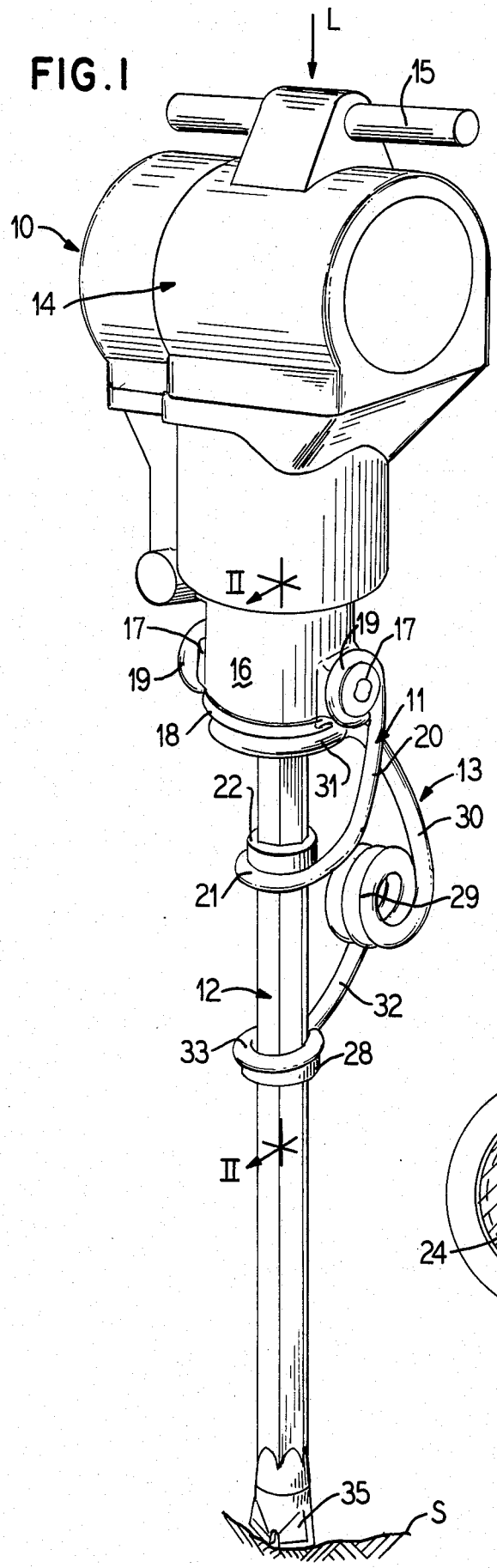
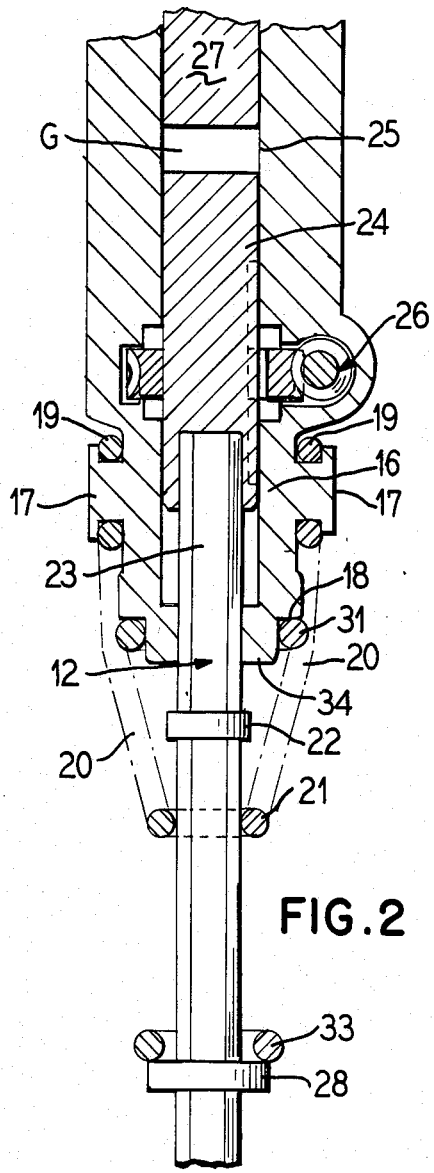
FIG. 2
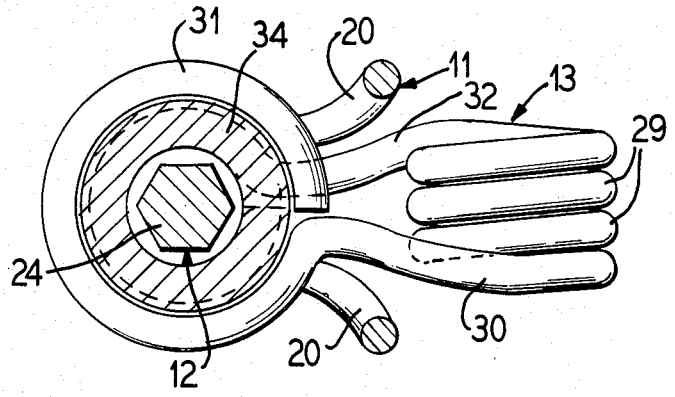
FIG. 5

DRIVER TOOL

FIELD OF THE INVENTION

This invention relates to the art of power hammer tools or jack hammers of the type having a piston delivering blows to an anvil for driving a tool such as a chisel, a drill, or the like and specifically deals with power hammers or jack hammers having a rapidly reciprocating hammer actuated by pneumatic, hydraulic, electric, or gasoline motors where an anvil impacted by the hammer is spring loaded to hold the tool against the workpiece and accommodate downcrowding loads while maintaining optimum spaced relation between the hammer and anvil.

BACKGROUND OF THE INVENTION

Power hammers or jack hammers having rapidly oscillating pistons or heads delivering blows to an anvil have been provided with recoil springs to dampen vibration or jumping of the hammer. These springs have been of the cylindrical helical type housed within the body of the jack hammers requiring extension of the housing and had no relationship to the hardness or impact resistance of the work being acted upon by the tool. They were relatively weak, being collapsed under appreciable downcrowding loads to present a solid column between the tool and the hammer, generating heat and a violent pogo stick action.

It would be an improvement in this art to provide anexternal, easily changed spring attachment between the jack hammer housing and the anvil impacted tool effective to maintain the tool in contact with the work and provide an operating clearance gap between the anvil and the hammer.

It would be a specific improvement in this art to provide a torsion or hairpin type spring bottomed at one end on the jack hammer housing and at the other end on the tool to accommodate a lengthy tool stroke without collapsing the spring.

It would be a still further specific improvement in this art to correlate the spring stiffness with the hardness or impact resistance of the work using weaker springs for relatively soft work usage.

SUMMARY OF THE INVENTION

According to this invention, there is provided an external easily replaced spring attachment for power hammers or jack hammers of the type having a rapidly oscillating piston or hammer impacting to drive a tool. This attachment imparts a spring bias between the power hammer casing and the tool driven by the power hammer for holding the tool against the workpiece and reclaiming an optimum gap between the anvil and the hammer or piston under a downcrowding load applied to the power hammer. The spring bias is tailored to fit use conditions with weaker springs being provided when the work acted on by the tool is relatively soft or easily broken and with stiffer springs being provided when the work is hard and offers increased resistance against abrasion by the tool.

The spring attachment is of the torsion spring or hairpin spring type with one end bottomed on the power hammer casing and the other end bottomed on a shoulder provided by the tool. These ends are preferably looped providing eyes readily receiving the casing and the tool. To replace the spring to suit various use conditions, the tool only need be removed from the conventional retainer of the jack hammer permitting the spring to easily drop off of the hammer casing and tool so that the tool and casing can immediately receive a stiffer or weaker spring attachment.

The torsion spring or hairpin spring accommodates both axial and rotational movement between the casing and the tool and cannot collapse to a non-yield condition. Since the spring is completely externally mounted, no modification of conventional jack hammer configurations or sizes is required and the same type of attachment fits substantially all commercial jack hammers.

The spring bias provided by the attachment is sufficient to support the jack hammer when the tool is resting on the work in its most extended position and the spring then yields under manually or mechanically applied downcrowding loads on the jack hammer to bring the anvil, which may be the upper end of the tool or a separate head abutting the upper end of the tool, to a level or "sweet spot" for receiving the most efficient impact blows from the hammer or piston. The spring is stiff enough to spring hold the tool on the surface being impacted after each impact.

The downcrowding load applied to the jack hammer will vary depending on use conditions. In hand held jack hammers the downcrowding loads will vary, for example between 20 to 100 pounds, before bottoming the piston on the anvil. In installations where the downcrowding of the jack hammer is mechanically applied as by a down powered arm or boom, greater loads are available and stiffer springs are provided. The stiffness of the spring and the downcrowding load are adjusted to create the optimum power stroke space between the hammer and anvil for delivering maximum output of the jack hammer When operating in soft or yielding work where the tool penetrates appreciably on each blow, the rebound is less than when operating in hard non-yielding work and the downcrowding load will be less so that a "light" spring will maintain the optimum gap or space between the hammer and anvil. This spring is easily replaced with a stiffer spring when operating harder work where increased downcrowding loads are applied. The spring should yield just enough to hold the tool on the work while supporting the applied downcrowded load and maintaining the operating gap between the hammer and anvil. The spring should also have a long range of movement without collapsing to accommodate long driving strokes of the tool.

It is then an object of this invention to provide spring attachments for power hammers or jack hammers exerting a spring bias between the jack hammer casing and the tool which transmits downcrowding loads on the jack hammer to the tool without collapsing the spring.

Another object of this invention is to provide an easily exchanged external spring attachment for jack hammers providing a resilient bias between the jack hammer casing and the tool driven by the jack hammer.

Another object of the invention is to provide a torsion spring attachment for jack hammers.

A specific object of the invention is to provide a hairpin spring external attachment for jack hammers which holds the jack hammer driven tool against the workpiece and maintains an optimum driving relationship between the hammer and anvil with applied downcrowding loads on the jack hammer.

A further specific object of this invention is to provide torsion spring attachments easily externally mounted on standard jack hammers without modification of the structure to hold the tool on the work and maintain an optimum driving stroke for the hammer.

Another specific object of the invention is to provide torsion springs for jack hammers which have eye ends respectively bottomed on the jack hammer casing and on the tool suspended from the casing while accommodating rotation of the tool relative to the casing.

Other and further objects of this invention will be apparent to those skilled in this art from the following detailed description of the annexed sheets of drawings showing a best mode embodiment of the invention.

On the Drawings:

FIG. 1 is a front and side perspective view of a power hammer or jack hammer having an external torsion spring or hairpin spring attachment of this invention;

FIG. 2 is a fragmentary cross-sectional view on the line II—II of FIG. 1;

FIG. 5 is a transverse cross-sectional view along the line V—V of FIG. 4;

As Shown on the Drawings:

Figure 3:
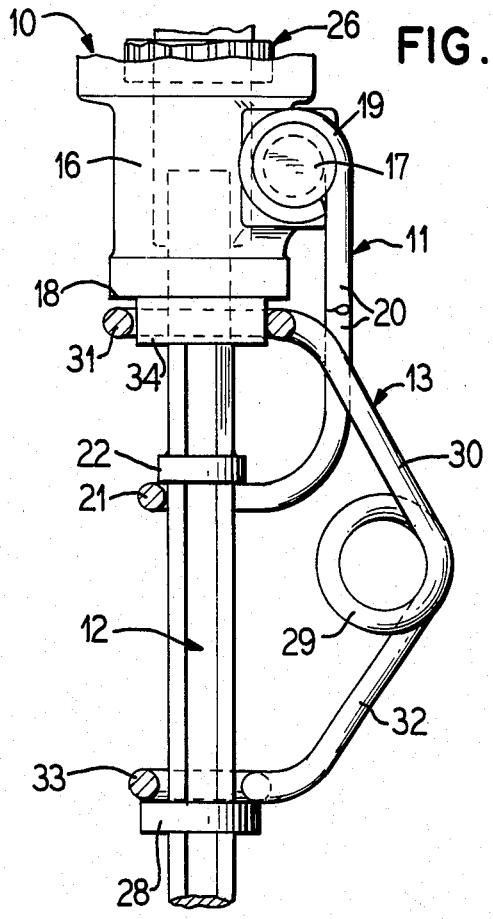
FIG. 3 is a fragmentary side elevational view of the jack hammer of FIG. 1 showing the spring attachment in relaxed condition.

The jack hammer 10 of FIG. 1 has a yoke retainer 11 suspending a chisel tool 12 and a torsion spring 13 of this invention is mounted externally on the jack hammer and tool.

The jack hammer 10 has a casing 14 with a handle 15 projecting from the top thereof to receive downcrowding loads L. These loads can be applied manually by an operator grasping the handle or the casing can be attached to the end of the downcrowding boom to apply the load L mechanically.

The casing has a cylindrical bottom boss portion 16 with laterally projecting lugs 17 and a flat bottom shoulder or ledge 18. The lugs 17 receive eye ends 19 of the retainer yoke 11. This yoke 11 is composed of stiff metal rod material with side legs 20 depending from the eye ends 19 and connected at a bight portion 21 spaced below the casing shoulder 18. The yoke 11 provides a pocket to receive the driving tool 12 and a collar 22 of the tool rests of the bight portion 21 to suspend it from the jack hammer casing.

As shown in FIG. 2, the tool 12 has a hexagonal rod end portion 23 above the collar 22 projecting into the case and seated in an anvil 24 slidably mounted in a cylindrical bore 25 of the casing. The anvil is rotated through a worm and gear drive 26 and a hammer or piston 27 slidable in the cylinder 25 above the anvil 24 is driven by a pneumatic, hydraulic, electric, or internal combustion engine mounted in the casing 14 to rapidly impact the anvil 24. The anvil slides through the rotating gear drive 26, but is rotated by this drive to rapidly oscillate and rotate the driver tool 12.

The tool 12 has a second collar 28 spaced below the collar 22 and of greater diameter.

The hairpin spring attachment 13 of this invention has a helically wound torsion spring body 29 with a first end leg 30 projecting upwardly therefrom and terminating in an eye 31 bottomed on the end shoulder 18 of the jack hammer casing. A second leg 32 depends from the other end of the torsion spring coil 29 to terminate in a larger diameter second eye 33 embracing the tool 12 and bottomed on the larger collar 28 of this tool.

Figure 4:
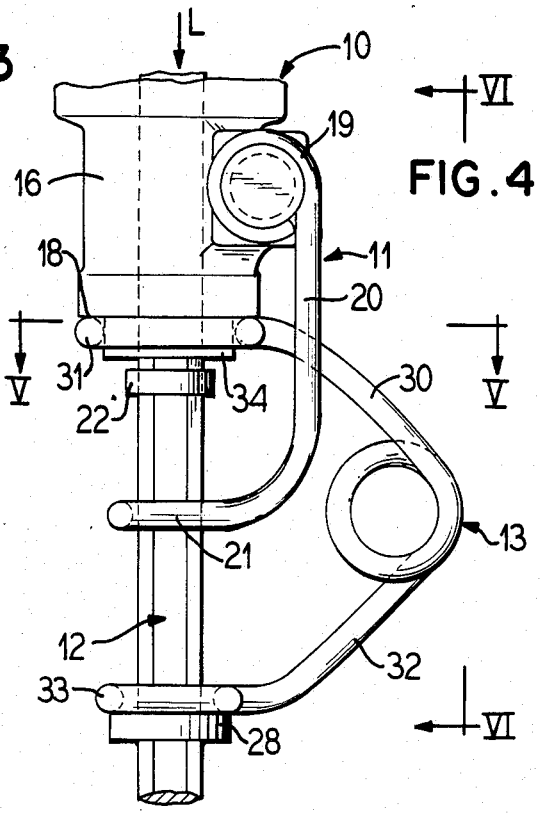
FIG. 4 is a view similar to FIG. 3, but showing the spring attachment in a loaded compressed condition.
Figure 6:
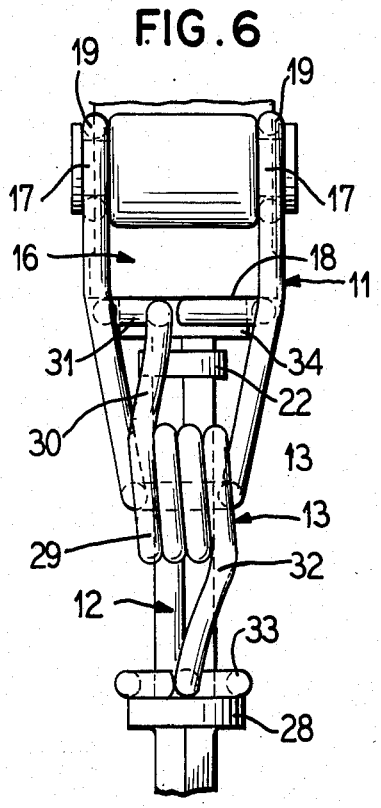
FIG. 6 is a fragmentary elevational view taking generally along the lines VI—VI of FIG. 4.

As shown in FIGS. 2–4, a reduced diameter collar portion 34 depends from the end wall or shoulder 18 of the casing portion 16 to snugly receive therearound the eye 31 of the spring attachment 13.

In the relaxed or expanded condition of the torsion spring 13, as shown in FIG. 3, the tool 12 is dropped downwardly from the jack hammer casing with the collar 22 of the tool bottomed in the bight portion 21 of the retainer yoke 20.

In the loaded condition of the jack hammer shown in FIG. 4, the tool 12 is pushed into the casing, the arms 30 and 32 of the spring 13 are squeezed toward each other with the eye 31 of the arm 30 being bottomed firmly against the shoulder 18 and the eye 33 of the arm 32 being bottomed firmly against the collar 28. The collar 22 is thus raised above the bight pocket 21 of the retainer yoke 11.

In the fully expanded or relaxed condition of the spring 13, the gap G between the anvil 24 and hammer or piston 27, illustrated in FIG. 2, is greater than the stroke of the piston so that the anvil is not impacted or does not receive an appreciable driving blow from the piston. However, when the downcrowding load L is applied to the jack hammer, the chisel end 35 of the tool 12 is pressed against the work surface S, as illustrated in FIG. 1, and the spring 13 is compressed, as illustrated in FIG. 4, thereby pushing the end 23 of the tool 12 into the casing, raising the anvil 24 and decreasing the gap G so that the piston or hammer 27 will strike a power blow to the anvil 24. The tension of the spring 13 is such that an optimum gap G will be maintained in operation of the hammer when downcrowding loads within an optimum range are applied to the jack hammer.

If the working surface S is relatively soft or yielding, the spring 13 should be weaker than when the surface S is hard and non-yielding and higher downcrowding loads are needed to operate the jack hammer. The spring stiffness should always be sufficient to hold the chisel end 35 of the tool 12 against the work surface S, but should be weak enought to absorb the recoil following the impact and reclaim the optimum gap between the anvil and piston for the next driving blow. In general, when the work surface S is hard rock, the spring 13 should be 30–50% stiffer than when the tool is used on a work surface composed of sand or soil. For example, delivery of 60 foot per pounds by the jack hammer in sand or soil would suggest use of a 90 pound spring while delivery of the same type of blow against rock would suggest a 120 pound spring.

The power hammers or jack hammers generally operate in the range of 900 to 3000 blows or strokes per minute. The torsion springs of this invention do not in any way impede the rapid oscillations of the tool 12, even under these high frequence impacts.

To attach or remove the spring 12, it is only necessary to swing the retainer yoke 11 about the ears or lugs 17 to move the bight portion 21 out from under the casing. This permits the tool 12 to drop out of the open bottom of the jack hammer casing whereupon the spring 13 is easily lifted off of the tool with the larger eye end 33 of the spring fitting freely around the smaller collar 22 of the tool. A different spring 33 is then reapplied to the tool, and the tool with the spring thereon then has the end 23 inserted into the jack hammer casing 11 so when the yoke 11 is swung back under the casing, the bight portion 21 will be under the collar 22.

Figure 7:
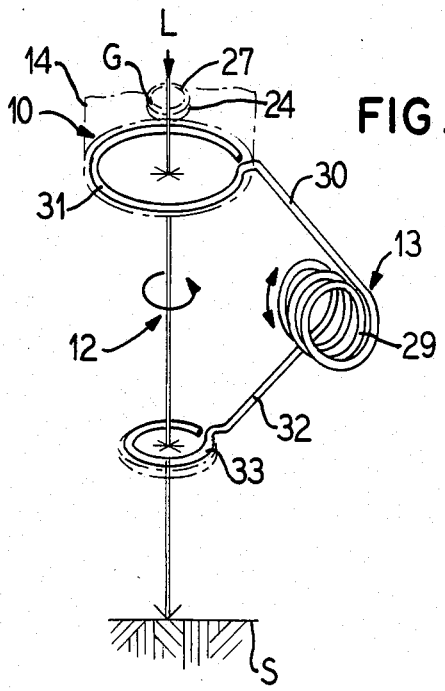
FIG. 7 is a diagrammatic illustration of the operation of the spring attachment.

As illustrated in FIG. 7, the coils 29 of the spring 13 twist as the eye ends 31 and 33 are moved toward and away from each other. With the tool 12 resting on the work surface S and with a downcrowding load L applied to the jack hammer casing 14, the spring 13 will be sqeezed to hold the tool against the surface S and to hold the jack hammer casing at a level so that the clearance gap G will be maintained between the anvil 24 and piston 27. The eye ends 31 and 33 of the spring 13 permit rotation of the tool 12 when the rotating mechanism 26 of the jack hammer is powered.

From the above descriptions is will therefore be understood that the spring attachment 13 of this invention performs a highly useful function in the operation of the jack hammers, is externally mounted to fit all types of jack hammer constructions, and is easily replaced to accommodate different types of work conditions.

I claim:

1. An easily removable spring attachment for a power hammer of the type having a casing, a tool suspending yoke depending from the casing, an anvil head slidable in the casing, a tool having a rod portion projecting into the casing with an end engaging said anvil head in the casing, said rod portion slidable through said yoke and having a first collar bottoming on the yoke to maintain the end of the rod in the casing and a driving piston in the casing impacting said anvil to drive the tool, which comprises a second collar on said rod portion of the tool spaced below the yoke, a replaceable external torsion spring having a first arm with a first eye end freely bottomed on said casing and a second arm with a second eye end freely bottomed on said second collar of the tool, said torsion spring being effective to hold the tool on the work and to space the anvil head from the driving piston, said second eye end being larger than said first eye end and said first collar to facilitate removal of the tool when the yoke is removed from the tool.

2. The spring attachment of claim 1 wherein said first and second eye ends loosely embrace the tool rod portion to accommodate rotation of the tool relative to the casing.

3. The spring attachment of claim 2 wherein said first and second arms of the spring carrying the first and second eye ends in substantially spaced relation to prevent collapse of the spring even when the anvil head is bottomed on the driving piston.

4. The attachment of claim 2 wherein the eye ends loosely embrace the tool to facilitate removal of the attachment from the jack hammer and tool.

5. The attachment of claim 1 wherein each eye end has a top face and a bottom face, the bottom of the casing has a shoulder abutting the top face of the first eye end, and the second collar abuts the bottom face of the second eye end.

6. The attachment of claim 1 wherein the yoke is swingable on the casing into and out of engagement with the first collar and accommodates rotation of the tool.

7. A removable external attachment for jack hammers of the type having a casing, an anvil slidable in the casing, a driving piston in the casing impacting the anvil, a tool suspended from the casing driven by the anvil to impact a work surface and which attachment holds the tool against the work surface and maintains an optimum driving gap between the piston and anvil, which comprises a hairpin spring outside the casing having a first arm with a first eye end bottomed on the casing and a second arm with a second eye end embracing the tool, and said tool having a collar bottoming said second eye end and accommodating rotation of the tool whereby compression of said spring by a load on the casing will hold the tool against the work surface and maintain an optimum driving gap between the piston and anvil of the jack hammer.

* * * * *